US005921394A

United States Patent [19]

Shroff

[11] Patent Number: 5,921,394

[45] Date of Patent: Jul. 13, 1999

[54] PILL STORAGE BOX AND DISPENSER

[75] Inventor: Chandrakant C. Shroff, Alexandria, Va.

[73] Assignee: Nirman Foundation, Alexandria, Va.

[21] Appl. No.: 08/764,592

[22] Filed: Dec. 13, 1996

[51] Int. Cl.[6] ..... B65D 83/04

[52] U.S. Cl. ..... 206/534; 206/533; 312/125

[58] Field of Search ..... 206/528, 534, 206/535, 536, 538, 533, 540, 315.11, 459.5; 211/163; 312/125, 97.1, 295; 220/213, 345

[56] References Cited

U.S. PATENT DOCUMENTS 3,378,134 4/1968 Wilkinson et al. ..... 206/315.11
4,245,742 1/1981 Rossmo ..... 206/533
4,381,059 4/1983 Schurman .
4,632,474 12/1986 Ingersoll ..... 312/125
4,753,340 6/1988 Blakeman et al. ..... 206/538

*Primary Examiner*—Paul T. Sewell
*Assistant Examiner*—Luan K. Bui
*Attorney, Agent, or Firm*—Papan Devnani, Esq; Thomas A. Powers; C. C. Shroff

[57] ABSTRACT

A pill container having a plurality of compartments, featuring a hollow cylindrical container having a top plate, a bottom plate, and a tubular wall which rotates relative to the top and bottom plates. A plurality of walls rigidly fastened to the top plate divide the interior of the container into a set of wedge-shaped compartments which may be individually accessed through a hinged door in the tubular wall.

19 Claims, 6 Drawing Sheets

PILL STORAGE BOX AND DISPENSER

FIELD OF THE INVENTION

The invention relates to containers for storage and dispensing of pills and/or tablets. More particularly, the invention relates to pill containers having multiple compartments, with each compartment being adapted to contain one or more pills. Each compartment is individually labeled with the day of the week and/or time of day at which the pills in that compartment should be taken.

BACKGROUND OF THE INVENTION

It is important that when medicine is prescribed for an individual to treat a medical condition, the correct dosage of the medicine should be taken at certain specified times to prevent the level of medication in the body from falling below a desired therapeutic level. Unfortunately, medical professionals have found that people often forget to take their medicine on time. Sometimes they miss one or more doses entirely. This is a particularly a problem with the elderly, who often become confused or absent-minded when trying to keep track of whether they have taken the correct does of each of a number of medications at the correct times.

Thus, there is a need for devices which store individual doses of pills or tablets in separate compartments. Each compartment should be labeled so that the user can tell at what day and/or time the dosage in that compartment should be taken. For example, pills to be taken on Monday can be stored in a first compartment; pills to be taken on Tuesday can be stored in a second compartment; and so on. This allows the patient to readily determine what pills should be taken at what time, and to readily check to determine whether those pills have in fact been taken.

A number of devices of this type have been developed. Pill containers having seven compartments (one for each day of the week), each of which may be individually accessed through a separate hinged door, are well known. U.S. Pat. No. 4,381,059, issued to Schurman on Apr. 26, 1983, discloses a cylindrical pill container having stacks of radially-directed compartments adapted to store individual doses of medicament(s). The pills are removed from the container through a sliding door in the side wall of the cylindrical container. The door is moved from one radial compartment to the next radial compartment by rotating the side wall relative to the radially-directed compartments. However, the structure of the container is relatively complicated, and a simplified structure is desirable. Additionally, it is desirable to have a door mechanism which allows the user to access only one compartment in a stack of radially directed compartments. The door in Schurman's device can only allow access to the third compartment from the bottom in a desired row of radially-directed compartments by sliding past the first and second compartments. If the door is withdrawn too far, medication stored in the third and fourth compartments may accidentally be removed together.

The objective of this invention is to provide a multi-compartment pill storage container having a simplified structure.

SUMMARY OF THE INVENTION

The current invention is a pill container having a plurality of compartments. The pill container comprises a hollow cylindrical container, said container comprising a top plate, a bottom plate, and a tubular wall having a hinged door. The tubular wall is secured to the top plate in such a way that the tubular wall is able to rotate about the axis of the container without rotating the top plates. The tubular wall is also secured to the bottom plate. The tubular wall may or may not be able to rotate relative to the bottom plate.

A plurality of interior walls rigidly fastened to said top plate divide the interior of the container into a set of wedge-shaped compartments adapted to hold pills or tablets. These walls radiate outwardly from the axis of said container until they reach the tubular wall. These interior walls are not secured to the tubular wall, so that when the tubular wall is rotated relative to the top plate, it also rotates relative to the interior walls. Thus, when the tubular wall rotates, the position of the door changes relative to the position of the wedge-shaped compartments defined by the interior walls.

The door is large enough to allow ready access to the contents of a single one of the wedge-shaped compartments. The door may be used to gain access to the contents of a desired wedge-shaped compartment by rotating the tubular wall relative to the interior walls until the door is positioned over the desired compartment. The door may then be opened, and the contents of the desired compartment may be removed.

By incorporating barrier walls which are parallel to the top and bottom plates, the wedge-shaped compartments can be subdivided to form a stack of subcompartments. The door in the tubular wall can be used to access all of the subcompartments in a given stack simultaneously. Alternatively, the door can be divided into a plurality of smaller doors, each of which accesses a single subcompartment in a given stack.

DESCRIPTION OF THE PREFERRED EMBODIMENTS

Figure 1:
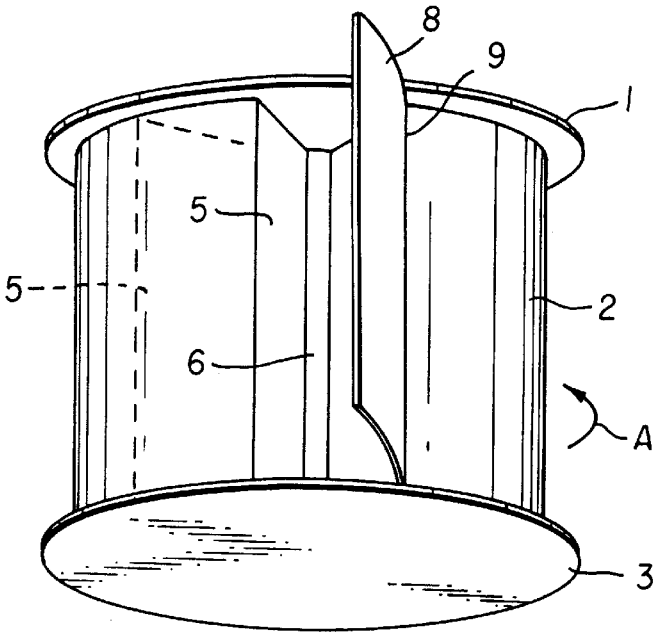
FIG. 1 shows a first embodiment of the inventive pillbox.

A first embodiment of the pillbox of the present invention is shown in FIG. 1. The pillbox is a hollow cylindrical container which comprises a flat circular top plate 1, a tubular wall 2 and a bottom plate 3. The interior of the container is divided into wedge-shaped compartments by a plurality of interior walls 5 which radiate outwardly from the axis of the container to the interior of wall 2. Walls 5 are rigidly attached to top plate 1. Wall 2 is attached to top plate 1 and bottom plate 3 in such a way that wall 2 may move relative to top plate 1 and interior walls 5 by rotating about the axis of the container in the direction of arrow A. Bottom plate 3 may or may not be able to move relative to top plate 1. A door 8 in wall 2 may be used to gain access to the interior of one of the wedge-shaped compartments. Door 8 is attached to wall 2 by a living hinge 9. Door 8 may be moved over a selected one of the wedge-shaped compartments by rotating wall 2 in the direction of arrow A, relative to the interior walls 5.

Figure 3A:
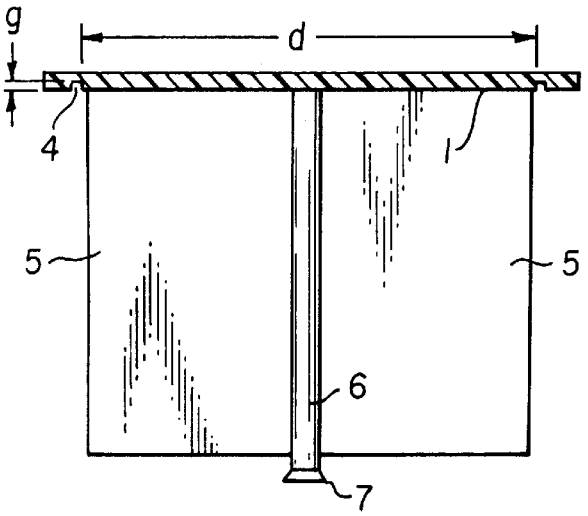
FIGS. 3*a* to 3*d* show detailed views of the individual parts of the pillbox of FIG. 1.
Figure 2:
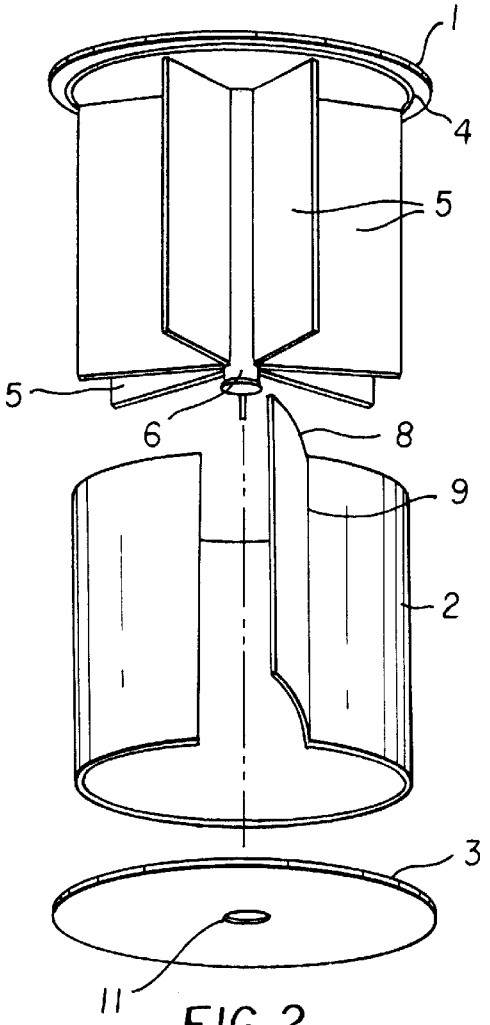
FIG. 2 shows an exploded view of the pillbox of FIG. 1.

The pillbox is made from three pieces, as show in the exploded view of the pillbox in FIG. 2. The first of these pieces is a top piece, as seen in FIG. 2 and FIG. 3*a*. The top piece is made from a round plate 1. There is a circular groove 4 having a diameter d and depth g on the perimeter of one side of plate 1. A post 6 is mounted on the same side of plate 1 as the groove. This post is located at the center of the area defined by groove 4. Post 6 is perpendicular to the surface of plate 1, and has a height of h+x, measured from the surface of plate 1. A set of planar rectangular walls 5 are rigidly fastened to post 6 by a first edge, as well as to plate 1 by a second edge which is at right angles to the first edge. Walls 5 have a height h, measured from the surface of plate 1, and radiate outwardly from post 6 to the inner edge of groove 4. Walls 5 must not obstruct access to groove 4. Preferably, the top piece is molded as a single unit.

Figure 3B:
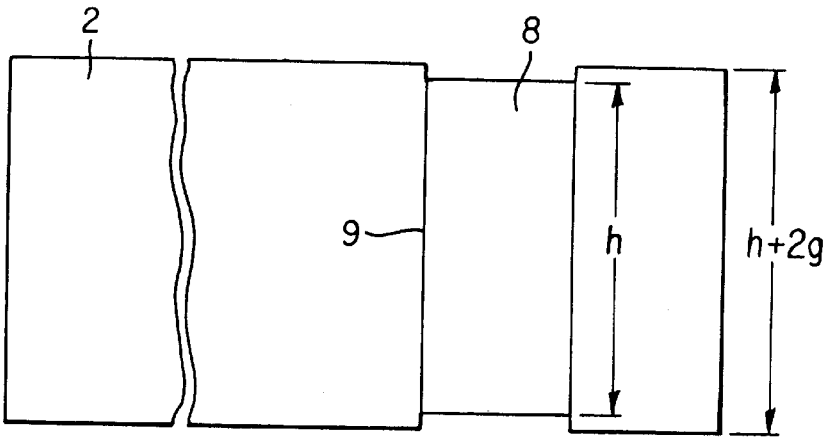
Figure 3C:
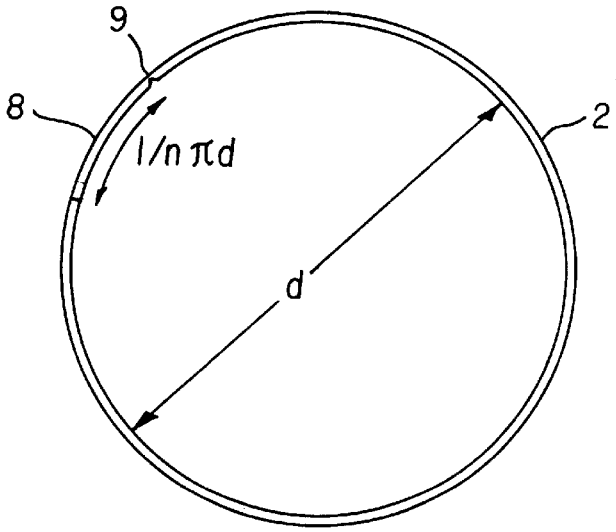

The second piece is a tubular wall 2 of diameter d. The tubular wall is shown in a side view in FIG. 3*b,* and in a front view in FIG. 3*c*. The wall is preferably made by molding a flat sheet of polyolefin or other plastic. The flat sheet is molded in the form of two rectangular segments connected by a living hinge. The first segment has a length of $n-1/n[(\pi)d]$ and a width of h+2g, where n is the number of walls 5. The second segment has a length of $1/n(\pi)d$ and a width of h. The living hinge connects a first side of width h+2g of said first segment to a first side of width h of said second segment, with the proviso that the first segment extends beyond the first segment by a distance g on both sides. The flat sheet is then shaped into a tube of diameter d, with the free second end of width h+2g of the first segment meeting the free second end of width h of the second segment. This tube is used as tubular wall 2. The tube slides over the walls 5 of the top piece, and one end of the tube fits into groove 4, as shown in the exploded view in FIG. 2. Tubular wall 2 features a door 8 of height h and width $1/n[(\pi)d]$ which is connected to wall 2 by living hinge 9. The bottom of the door does not extend into groove 4, so the door is free to swing open and shut. A means of reversibly snapping the door into a shut position should be included. This may take the form of a ridge on the free end of door 8 which snaps into a slot on the free end of wall 2.

Figure 3D:
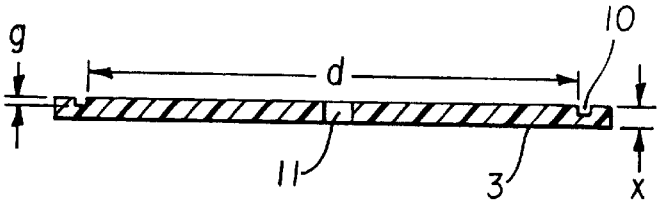

The third piece is circular bottom plate 3, having a thickness x. A cross-sectional view of plate 3 is shown in FIG. 3*d*. Plate 3 features a circular groove 10 of diameter d and depth g on one of its faces, and a hole 11 through the center of the plate. Groove 10 and hole 11 are concentric. Hole 11 is large enough tot allow plate 3 to slide over the free end of post 6, with the face of plate 3 having groove 10 being directed toward top plate 1. The free end of tubular wall 2 slides into groove 10, and top plate 3 is secured in position on post 6, as shown in the exploded view of the pillbox in FIG. 2. Plate 3 may be rigidly secured to post 6 by means of an adhesive. Alternatively, plate 3 may be secured to post 6 by providing a ridge 7 on post 6 which has a slightly larger diameter than both post 6 and hole 11. Plate 3 may then be snapped into position by forcing hole 11 over ridge 7. In this case, it is not necessary that Plate 3 be unable to rotate relative to top piece 1. The top and bottom pieces may be molded from transparent plastic, or from opaque plastic of any color. It is preferred that the tubular wall be manufactured from transparent plastic to allow visual inspection of the contents of the container.

Pills or tablets may then be placed in one of the compartments in the completed pill container by rotating tubular wall 2 relative to top piece 1 until door 8 is positioned over one of the wedge-shaped compartments. Door 8 is then opened, tablets are placed inside the compartment, and the door is then closed. Wall 2 may then be rotated relative to top piece 1 until door 8 is positioned over a second wedge-shaped compartment. Medicine may then be placed in the second wedge-shaped compartment. Medicine may be removed from a wedge-shaped compartment in a similar fashion.

Preferably, seven interior walls 5 are provided in the pillbox. The exterior surface of top plate 1 is provided with a design that divides the exterior surface into seven wedge-shaped sections. Each wedge-shaped section corresponds to one of the days of the week, and is individually labeled. These labels may take the form of letters or abbreviations (For example, Monday would be "M" or "MON"). Alternatively, color coding may be used, with each wedge-shaped section on the exterior surface being a different color. The position of the boundaries between wedge-shaped sections on the exterior surface of top piece 1 should correspond to the position of walls 5 inside the pill container. If desired, a different number of walls 5 may be employed. For example, if medicine is to be taken three times a day, three walls 5 dividing the container into three compartments may be provided. A first compartment would then be labeled "morning"; a second compartment would then be labeled "noon" and a third compartment would then be labeled "night".

Figure 4:
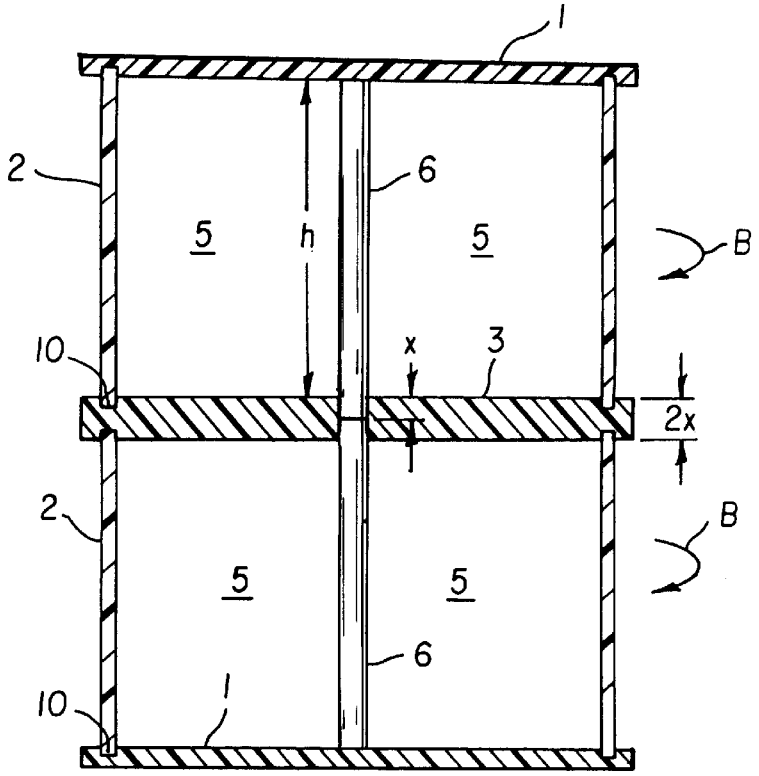
FIG. 4 shows a second embodiment of the inventive pillbox.

A second embodiment of the invention is illustrated in FIG. 4. In this embodiment, bottom plate 3 has a thickness 2x, and a groove 10 is present on both faces of plate 3. The grooves 10 overlie each other exactly. Hole 11 runs entirely through plate 3. A tubular wall 2 is fitted into the groove on the top face of plate 3, and a second tubular wall 2 is fitted into the groove on the bottom face of plate 3. Two top pieces identical to that shown in FIG. 3*a,* except that no ridge 7 is present, are then positioned in the pill container by sliding walls 5 of a first top unit into a first wall 2 until the end of the first wall 2 slides into groove 4, and the end of post 6 slides into hole 11. The walls 5 of a second top piece are then slid into a second wall 2 until the end of the second wall 2 slides into groove 4 of the second top piece, and the end of post 6 of the second op piece slides into hole 11. The ends of the two posts 6 meet halfway through hole 11. The positions of the walls in the first top piece should line up exactly with the positions of the walls in the second top piece, and the top pieces and plate 3 should be rigidly secured together to prevent them from moving relative to each other. The final structure has a set of upper wedge-shaped compartments and a set of lower wedge-shaped compartments which are separated from each other by plate 3. Tubular walls 2 are free to rotate around the axis of the container, relative to a fixed plate 3, independently of each other.

Figure 5:
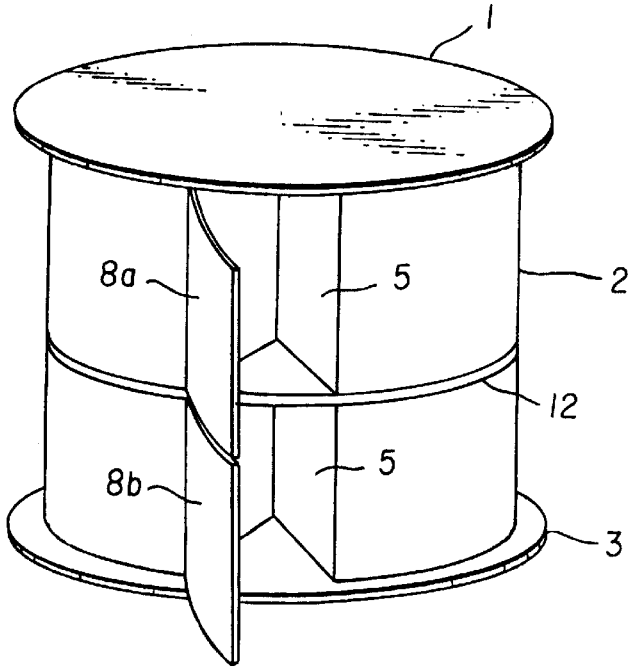
FIG. 5 shows a third embodiment of the inventive pillbox.

In a third embodiment which uses only one tubular wall, one or more barrier walls may be used to divide each wedge-shaped compartment into a plurality of smaller subcompartments, as shown in FIG. 5. Each wall 12 is a disk-shaped structure intersecting each of the interior walls 5. Walls 12 have a diameter d, and are parallel to the bottom plate 3. For example, each compartment may be subdivided into an upper subcompartment and a lower subcompartment by a barrier wall 12, which is located midway between the top plate and the bottom plate. Assuming that each compartment contains one day's supply of pills, pills to be taken in the morning may be placed in the upper subcompartment, and pills to be taken in the evening may be placed in the lower subcompartment. The compartments may be subdivided into a larger number of subcompartments by using a greater number of barrier walls. It is preferred to use from one to three barrier walls 12. The barrier walls should be evenly spaced from each other and from the top and bottom plates.

Door 8 on tubular wall 2 may be used to gain access to the contents of all subcompartments in a given wedge-shaped compartment simultaneously if desired. Alternatively, the door may be divided into several smaller doors that open and close independently of each other. For example, if each compartment is subdivided into an upper subcompartment and a lower subcompartment by a barrier wall 12, the door may be subdivided into an upper door 8*a* and a lower door 8*b,* as shown in FIG. 5. The upper door may be opened to gain access to the upper subcompartment, and the lower door may be opened to gain access to the lower subcompartment. The position of the boundary between door 8*a* and door 8*b* should correspond to the position of barrier wall 12. If a larger number of subcompartments are present, door 8 may be subdivided into a larger number of smaller doors.

Figure 6:
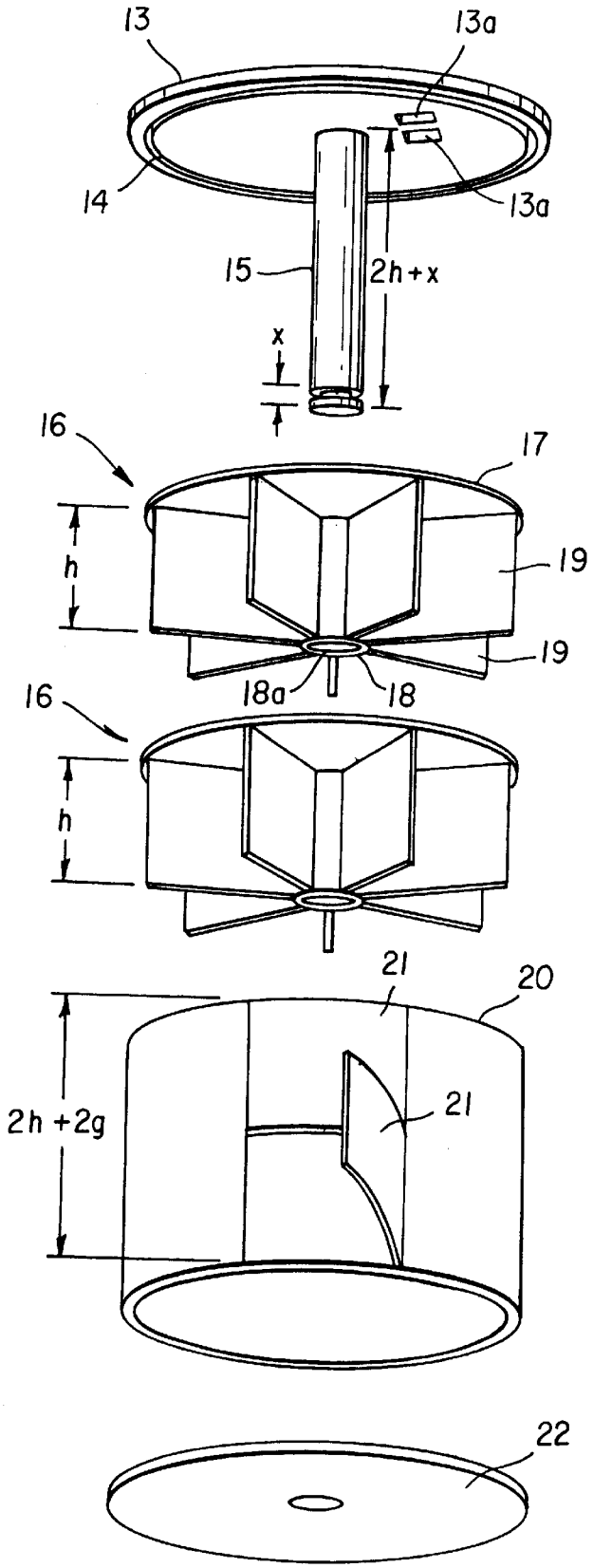
FIG. 6 shows an exploded view of the pillbox of FIG. 5, made using a first set of components.

A single unit comprising top plate 1, walls 5, barrier walls 12, and post 6 may be molded if desired. However, the complicated nature of the mold required makes sectional construction both more attractive and more convenient, as shown in the exploded view in FIG. 6. The top piece comprises a circular top plate 13 having, on one face, a circumferential groove 14 of diameter d and depth g. A post 15 of height mh+x, where m is the number of subcompartments desired in each wedge-shaped compartment of the finished product, is mounted in the center of plate 13. Post 15 is perpendicular to plate 13. Two radial slots 13*a* which are essentially parallel to each other are present on the grooved face of plate 13. The slots are separated by a distance y from each other, and are inside the circle defined by groove 14.

Figure 7A:
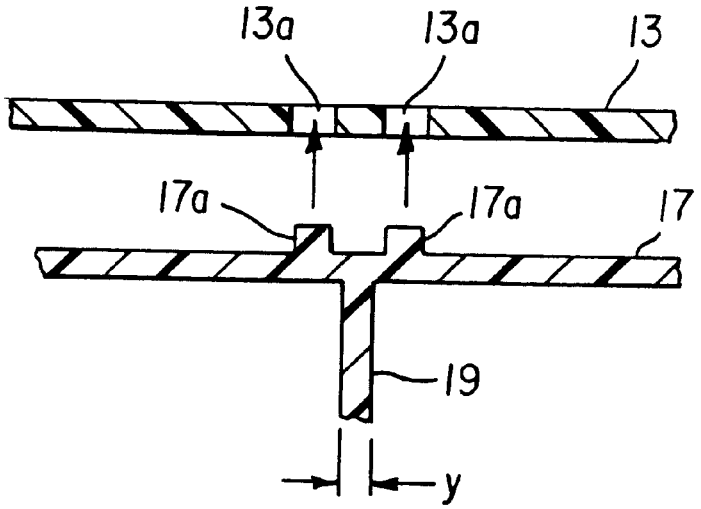
FIGS. 7*a* and 7*b* shows details of how the pillbox of FIG. 5 is assembled.

A plurality of wall units 16 are also provided. Each wall unit comprises a disk-shaped base 17 of diameter d and a post 18 which has a height h and a diameter which is greater than that of post 15. Post 18 is mounted perpendicularly on the center of a first side of base 17, and a bore 18*a* having a diameter which is equal to the diameter of post 15 runs through base 17 and post 18. The bore is concentric with base 17 and post 18. A plurality of rectangular walls 19 of height h and thickness y (note that the wall thickness is equal to the spacing between the slots in plate 13) are rigidly mounted on the first side of base 17. These walls radiate outwardly from post 18 to the edge of base 17. Two tabs 17*a* are present on the second side of base 17. These tabs are parallel to each other and are separated by a distance y. The tabs are positioned on opposite sides of one of the walls. The entire wall unit 16 may be positioned on the top piece by sliding post 15 on the top piece through the bore in the wall unit with the base of the wall unit facing toward base plate 13 of the top piece until base 17 contacts base plate 13. At this point, the tabs on base 17 slide into the slits on base plate 13 as shown in FIG. 7*a,* preventing unit 16 from rotating relative to top plate 13. It is important that the groove in plate 13 not be blocked by base 17.

Figure 7B:
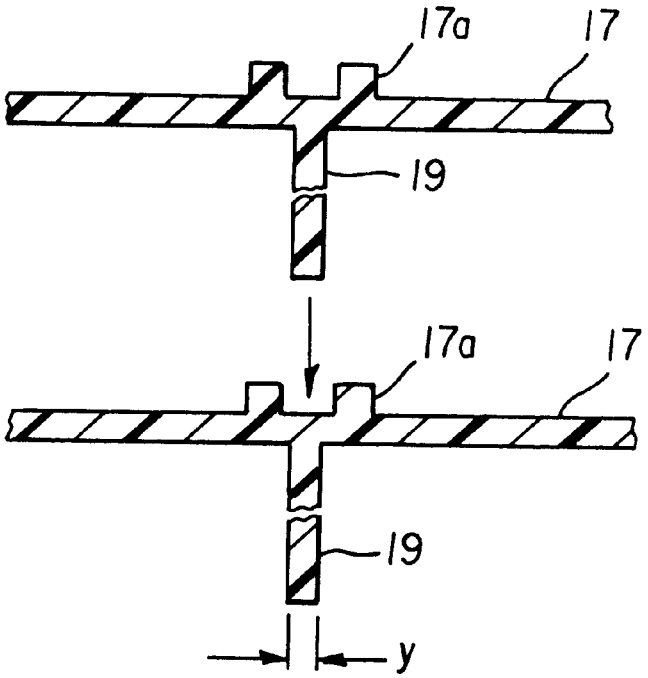

If a stack of two subcompartments is desired in each wedge-shaped compartment (m=2), a second unit 16 is then positioned on top of the first unit 16. The bore of the second unit 16 slides over post 15 with base 17 of the second unit 16 facing toward the first unit 16 until base 17 of the second unit 16 contacts the upper surface of the walls 19 of the first unit 16. The relative positions of the two wall units 16 are fixed by sliding one of the walls on the first unit 16 between the tabs on the second side of base 17 of the second unit 16, as shown in FIG. 7*b*.

A transparent tubular wall 20 having a diameter d and a length mh+2g then slides over wall units 16 until one end of wall 20 fits into the groove on plate 13. Wall 20 features a door 21 of height mh and width 1/n[(π)d] mounted to wall 20 by a living hinge, where n is the number of walls on each unit 16. The construction of wall 20 is essentially identical to that of wall 2, except that door 21 may be subdivided into several smaller doors having height h and width 1/n[(π)d], if desired. A bottom plate 22, which is essentially identical to previously described bottom plate 3, is then fitted to post 15 and tubular wall 2, using the previously described procedure for fitting plate 3 to post 6 and tubular wall 2. The resulting structure has a plurality of wedge-shaped compartments, each of which is subdivided into an upper subcompartment and a lower subcompartment. Tubular wall 20 is free to rotate relative to the wall units 16 and the plate 13. The base 17 of the second wall unit 16 serves as the barrier wall 12.

The outer side of plate 13 may be provided with labels or other insignia to distinguish one compartment from another. The individual subcompartments may also be manufactured in such a way that they are readily distinguishable from each other, preferably by molding wall units 16 from different colors of plastic. For example, a pill container my be divided into seven wedge-shaped compartments, each of which is subdivided into upper subcompartments and lower subcompartments. Plate 13 may be labeled in such a way that each wedge shaped compartment corresponds to a specified day of the week. The upper subcompartments may be made in a light color (e.g., white or light blue) by molding the upper wall unit 16 from a light-colored plastic, while the lower subcompartments may be made in a dark color (e.g., navy blue or black). The light-colored subcompartments are adapted to contain pills to be taken in the morning, while the dark subcompartments are adapted to contain pills to be taken at night.

Figure 8:
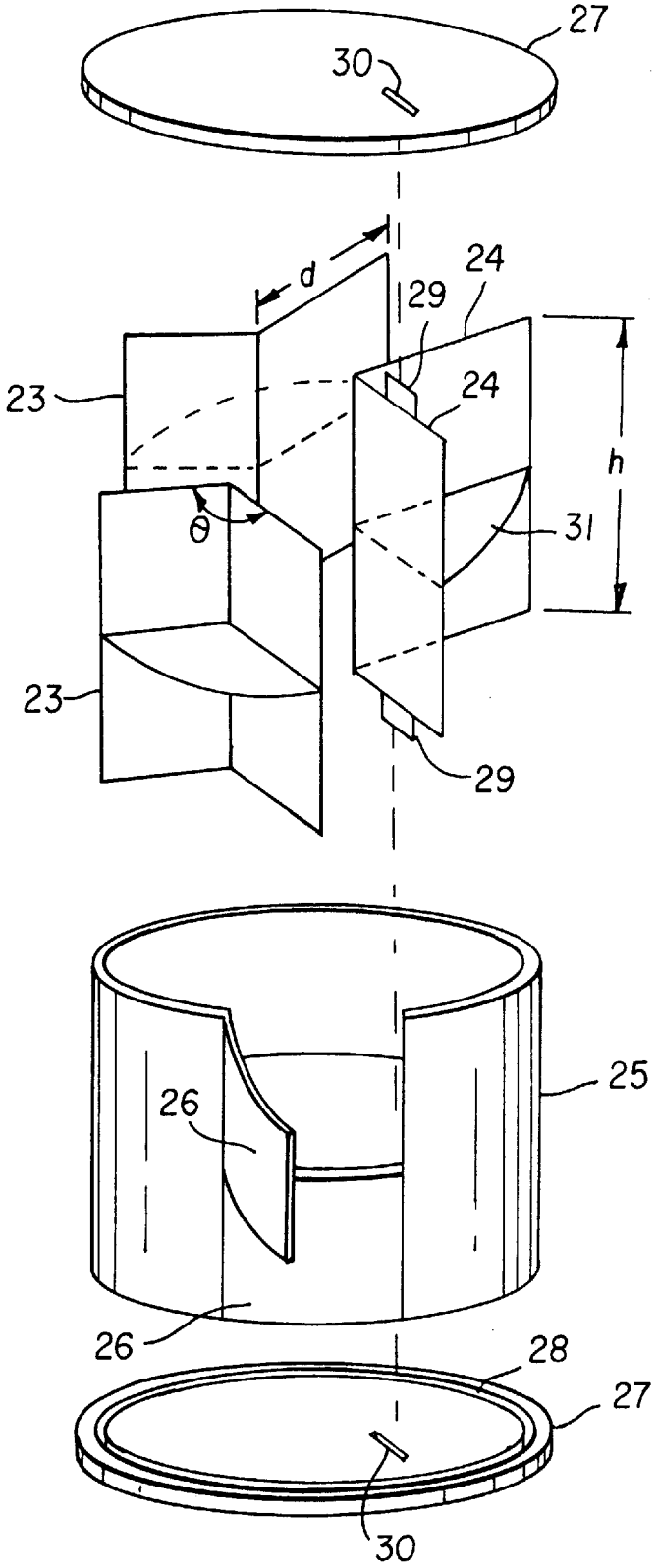
FIG. 8 shows an exploded view of the pillbox of FIG. 5, made using a second set of components.

In an alternative embodiment, illustrated in an exploded view in FIG. 8, the individual wedge-shaped compartments may be prepared using individually molded units 23. These units 23 feature two rectangular walls 24 of length d and height h, where the two walls intersect at an angle θ. The sides of the walls which intersect have a length h. A plurality of units 23 are used to manufacture a pillbox. The angle θ is defined to be 360/n degrees, where n is the number of units 24 which are used to manufacture the pillbox. All units 23 which are to be used in manufacturing the pillbox are inserted in a transparent tubular wall 25 of length h+2g having a hinged door 26, where wall 25 and door 26 are identical to wall 2 and door 8.

Two circular end plates 27 are provided, where each end plate has a circular groove 28 of diameter d and depth g. Each groove 28 is adapted to receive an end of tubular wall 25. Each end plate is placed over one end of tubular wall 25 so that wall 25 fits into groove 28. The end plates 27 are secured to the exposed end surfaces of walls 24, while leaving the tubular wall 25 to rotate relative to plates 27 and walls 24. This may be done permanently through the use of an adhesive, or temporarily by providing one or more of units 23 with a tab 29 on each end. Tabs 29 are each adapted to releasably snap into a slot 30 on end plate 27.

To aid the user in identifying a specific compartment in the pillbox, each unit 23 may be molded from a different color of plastic. Thus, when the pill container is assembled, the interior of each compartment will be a different color when viewed through the transparent tubular wall. If desired, each compartment may be subdivided into two or more smaller subcompartments by molding each unit 23 with a wedge-shaped shelf 31 which is mounted on walls 24, where the shelf 31 is perpendicular to each wall 24. If the compartments are subdivided in this manner, door 26 may be subdivided into a number of smaller doors, as shown in FIG. 8.

What is claimed is:

1. A pill container containing a plurality of compartments, comprising:

a hollow cylindrical container having a defined axis, said container comprising a horizontal bottom plate, a horizontal top plate, and a tubular wall open at both ends, said tubular wall having a hinged door, wherein said tubular wall is secured to the top plate and the bottom plate in such a way that (a) the tubular wall is able to rotate around the axis of the container without rotating the top and bottom plates, and (b) each of the top and bottom plates is sufficiently large that it cannot pass through either open end of the tubular wall; and a plurality of vertical walls rigidly fastened to said top plate which divide the container into a set of wedge-shaped compartments adapted to hold pills or tablets, wherein said walls radiate outwardly from the axis of the container to said tubular wall.

2. The pill container of claim 1, wherein the walls divide the container into a set of wedge-shaped compartments of equal size and shape.

3. The pill container of claim 1, wherein there are a plurality of walls dividing the container into a plurality of wedge-shaped compartments, wherein the number of walls is equal to the number of compartments.

4. The pill container of claim 3, wherein there are seven walls dividing the container into seven wedge-shaped compartments, with each compartment being labelled as corresponding to a specific day of the week.

5. The pill container of claim 3, wherein there are from two to four walls dividing the container into from two to four wedge-shaped compartments, with each compartment being labelled as corresponding to a specific time of the day.

6. The pill container of claim 1, wherein the hinged door on the tubular wall is large enough to allow access to the interior of one of the wedge-shaped compartments.

7. The pill container of claim 6, wherein the hinged door may be moved from a position where it does not allow access to the interior of a desired wedge-shaped compartment to a position where it does allow access to the interior of said desired wedge-shaped compartment by rotating the tubular wall about the axis of the container without rotating the top plate.

8. The pill container of claim 1, wherein:

a) the tubular wall is connected to the bottom plate by fitting one end of the tubular wall into a first circular groove in the bottom plate, said tubular wall and said first circular groove having the same diameter;

b) the tubular wall is connected to the top plate by fitting the other end of the tubular wall into a second circular groove in the top plate, said tubular wall and said second circular groove having the same diameter; and c) the position of the top plate is fixed relative to the bottom plate.

9. The pill container of claim 1, further comprising:

a means for fixing the position of the top plate relative to the position of the wedge-shaped compartments.

10. The pill container of claim 1, wherein each of said wedge-shaped compartments is individually labelled.

11. The pill container of claim 9, wherein each of said wedge-shaped compartments is individually labelled by positioning labels on said top plate, each of said labels being positioned directly above one and only one of the wedge-shaped compartments.

12. The pill container of claim 1, wherein the hinge door is connected to the tubular wall by a living hinge.

13. The pill container of claim 1, wherein each wedge-shaped compartment is divided into a plurality of subcompartments by a plurality of horizontal barrier walls.

14. The pill container of claim 13, wherein said hinged door on said tubular wall is divided into a plurality of smaller doors which may be opened independently of each other, wherein each individual smaller door in said plurality of smaller doors is adapted to access the interior of a single subcompartment selected from among said plurality of subcompartments.

15. The pill container of claim 1, wherein each wedge-shaped compartment is divided into an upper subcompartment and a lower subcompartment by a horizontal barrier wall.

16. The pill container of claim 15, wherein said hinged door on said tubular wall is divided into an upper door and a lower door which may be opened independently of each other, said upper door being adapted to access the interior of said upper subcompartment and said lower door being adapted to access the interior of said lower subcompartment.

17. The pill container of claim 1, wherein each wedge-shaped compartment is divided into a plurality of subcompartments by a plurality of barrier walls, each of said barrier walls being parallel to said top plate.

18. The pill container of claim 14, wherein each individual smaller door in said plurality of smaller doors is labelled with a specific time of day.

19. The pill container of claim 1, wherein the pill container was manufactured by a process of fitting the top plate to a first open end of the cylindrical wall so that the vertical walls occupy the interior of the cylindrical wall; fitting the bottom plate to a second open end of the cylindrical wall; and securing the top plate and the bottom plate to the cylindrical wall while leaving the cylindrical wall free to rotate relative to the top plate and the bottom plate.

* * * * *